US006831237B1

(12) United States Patent
Kruegel et al.

(10) Patent No.: US 6,831,237 B1
(45) Date of Patent: Dec. 14, 2004

(54) SWING ARM SWITCH ACTUATOR ASSEMBLY

(75) Inventors: Roy F. Kruegel, Laveen, AZ (US); David E. Boyer, Higley, AZ (US); Clark D. Barrand, Maricopa, AZ (US); Ross F. Meyer, Mesa, AZ (US); Jungsuk J. Ryu, Chandler, AZ (US); James Delaloye, Chandler, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/722,300

(22) Filed: Nov. 25, 2003

(51) Int. Cl.[7] ..... H01H 21/00
(52) U.S. Cl. ..... 200/6 R; 200/290
(58) Field of Search ..... 200/6 R–6 BB, 200/573, 574, 239, 244, 245, 250, 271, 273, 274, 275, 290

(56) References Cited

U.S. PATENT DOCUMENTS 3,264,442 A * 8/1966 Holzer ..... 200/244
3,515,831 A * 6/1970 Kerber et al. ..... 200/509
3,791,176 A 2/1974 Kohler et al.
RE28,249 E * 11/1974 Estrem ..... 200/574
3,937,912 A 2/1976 Martin
3,975,896 A * 8/1976 Kasama ..... 368/319
3,980,852 A 9/1976 Redfield
4,295,017 A 10/1981 Kashima et al.
4,677,260 A 6/1987 Nagasaki et al.
4,731,510 A * 3/1988 Nourry ..... 200/275
4,943,692 A 7/1990 Miyata
5,685,418 A * 11/1997 Chong et al. ..... 200/284
5,828,019 A 10/1998 Joyce
5,834,718 A 11/1998 Amonett
6,570,108 B2 * 5/2003 Lin ..... 200/6 B

* cited by examiner

*Primary Examiner*—Michael A. Friedhofer
(74) *Attorney, Agent, or Firm*—Douglas A. Mullen, Esq.

(57) ABSTRACT

An apparatus is provided for activating switches in a leading edge flap drive actuator. The apparatus comprises a mount plate having at least a first side, a second side, and an outer peripheral surface, an actuator arm rotationally coupled to the mount plate and rotationally moveable between at least an activate position and a deactivate position, and a spring arm coupled to the mount plate and extending away from the mount plate outer perpheral surface, the spring arm configured to supply a force that biases the actuator arm toward the deactivate position at least when the actuator arm is in the activate position.

19 Claims, 3 Drawing Sheets

SWING ARM SWITCH ACTUATOR ASSEMBLY

FIELD OF THE INVENTION

The present invention generally relates to switches, and more particularly relates to an assembly for activating a switch.

BACKGROUND OF THE INVENTION

Switches are used in many different environments, including various aerospace environments, in which switches may be used with other components to accomplish certain aircraft system and/or component operations. For example, switches may be employed in the aircraft monitoring system of leading edge flap drive assemblies. In such instances, when the aircraft leading edge flaps are extended or retracted, switches are typically activated or deactivated to indicate the position of the flaps. These indications may be communicated, via a display, to the pilot. In these configurations, the switches may be activated or deactivated by switch actuators that may in turn be controlled by other components such as, for example, a cam assembly. In such instances, the switch actuators may translate the rotary motion of the cam assembly to linear motion, to activate or deactivate a switch.

At times, it may be preferable to replace a switch actuator. In such instances, it is preferable for the replacement switch actuator to not only have a robust design for a prolonged life, but also for the replacement to be cost efficient.

Accordingly, there is a need for a robust and cost efficient switch actuator. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

In one embodiment of the invention, a switch actuator assembly is provided that includes a mount plate, an actuator arm and a spring arm. The mount plate includes at least a first side, a second side, and an outer peripheral surface. The actuator arm is rotationally coupled to the mount plate and rotationally moveable between at least an activate position and a deactivate position. The spring arm is coupled to the mount plate and extends away from the mount plate outer peripheral surface. The spring arm is configured to supply a force that biases the actuator arm toward the deactivate position at least when the actuator arm is in the activate position.

In another embodiment, a switch actuator assembly having a mount plate, a first and second actuator arm and a first and second spring arm is provided. The mount plate includes at least a first side, a second side, and an outer peripheral surface. The first and second actuator arms are each rotationally coupled to the mount plate and each rotationally and independently moveable between at least an activate position and a deactivate position. The first and second spring arms are coupled to the mount plate and each extend away from the mount plate outer peripheral surface. The first and second spring arms are each configured to supply a force that biases the first and second actuator arms toward the deactivate position, respectively, at least when the first or the second actuator arm is in the activate position.

In yet another embodiment, a switch actuator assembly is provided that includes a mount plate, an actuator arm, a spring arm and a switch assembly. The mount plate includes at least a first side, a second side, and an outer peripheral surface. The actuator arm is rotationally coupled to the mount plate and rotationally moveable between at least an activate position and a deactivate position. The spring arm is coupled to the mount plate and extends away from the mount plate outer peripheral surface. The spring arm is configured to supply a force that biases the actuator arm toward the deactivate position at least when the actuator arm is in the activate position. The switch assembly is disposed proximate the mount plate and includes a switch selectively moveable between a closed position and an open position in response to actuator arm movement between the activate and deactivate positions, respectively.

BRIEF DESCRIPTION OF THE DRAWINGS

The invention will hereinafter be described in conjunction with the following drawing figures, wherein like numerals denote like elements.

DETAILED DESCRIPTION OF THE INVENTION

The following detailed description is merely exemplary in nature and is not intended to limit the invention or the application and uses of the invention. Furthermore, there is no intention to be bound by any theory presented in the preceding background or the following detailed description. In this regard, although the switch actuator is described as being implemented in an aircraft leading edge flap actuation system, it will be appreciated that it could be implemented in numerous other systems, both in or out of the aerospace industry.

Figure 1:
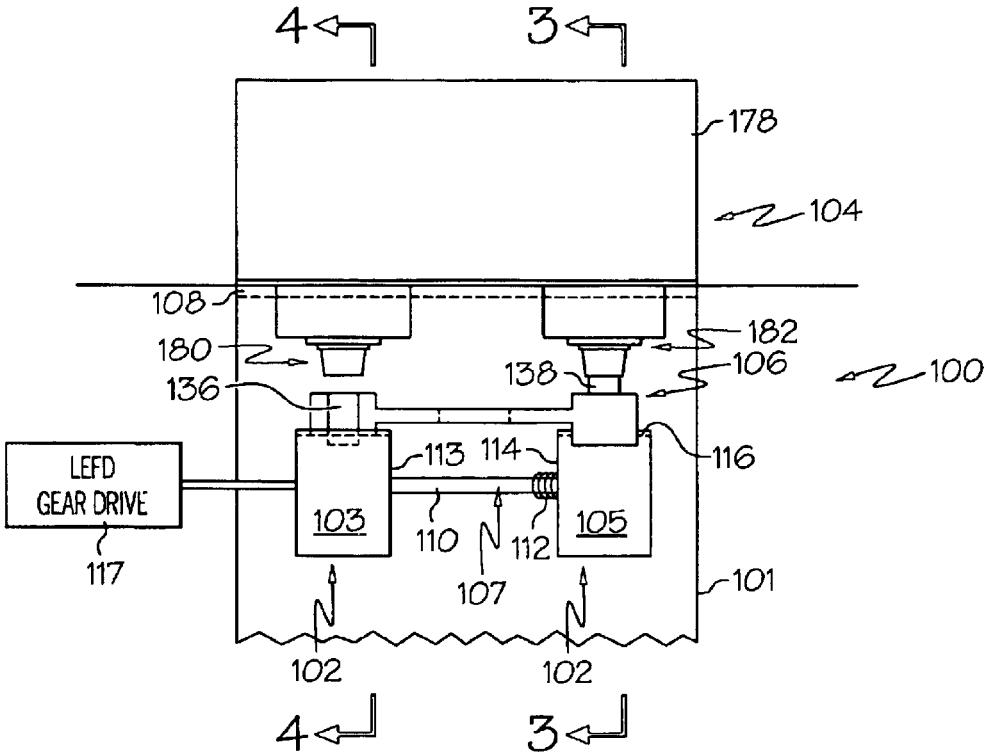
FIG. 1 is a cross sectional view of a switch actuator assembly in resting state, according to an exemplary embodiment of the invention.

FIG. 1 illustrates a cross-sectional view of a controller assembly according to an exemplary embodiment as employed in an aircraft monitoring system of an aircraft leading edge flap drive assembly. The depicted controller assembly 100 includes a cam assembly 102 and a switch actuator 106 which are disposed within a housing 101. A spacer 108 is installed between the housing 101 and the switch assembly 104. The switch actuator assembly 100 is shown to include both an activated and a deactivated switch 104, specifically, an activated retract switch 180 and a deactivated extend switch 182. In this embodiment, the cam assembly 102 and switch actuator 106 work together, as will be described more fully further below, to activate or deactivate switch assembly 104, which in turn causes a leading edge flap extend or retract position signal, respectively, to be sent to, for example, a display (not shown). It will be appreciated that the position signal may be sent to one or more displays either directly from the switch 104 or via one or more intermediate circuits. Each component of the controller assembly 100 and how they interact with one another will now be discussed.

Cam assembly 102 includes two cams, an extend cam 103 and a retract cam 105. The cams 103, 105 are coupled to one another via a translating screw assembly 107 that works with the switch actuator 106 to activate and deactivate switches 180 and 182 in the switch assembly 104, to thereby indicate, for example, different leading edge flap positions. Translating screw assembly 107 includes a splined shaft 110 which passes through cams 103, 105 and a translating nut 112 mounted on the shaft 110. Cams 103, 105 are each threaded to an outer floating nut (not shown). When shaft 110 rotates, nut 112, in turn, travels linearly along the shaft 110, between cams 103 and 105. Nut 112 engages the outer floating nut (not shown) of either the extend cam 103 or the retract cam 105, depending on the direction of a drive force supplied to the translating screw assembly 107 from the LEFD gear drive 117. Thus, for example, when implemented in a leading edge flap drive (LEFD) actuation system, translating screw assembly 107 is coupled to a LEFD gear drive 117. When a pilot commands the aircraft flaps to extend or to retract, the LEFD gear drive 117 supplies a drive force in the appropriate direction, causing the shaft 110 to rotate and nut 112 to translate along the shaft 110 between the extend and retract cams 103, 105. The nut 112 then engages with either the extend cam 103 or the retract cam 105, as appropriate. When the nut 112 engages either the extend cam 103 or the retract cam 105, the appropriate cam 103, 105 rotates a predetermined amount, engaging the switch actuator 106, and thereby appropriately activating or deactivating the switch assembly 104.

The extend and retract cams 103, 105 may be implemented in any one of nunerous known configurations, but in the depicted embodiment the cams 103, 105 are each generally short, cylindrically-shaped elements that have a groove 116 formed therein. It will be appreciated that the groove 116 may extend the entire length of the cams 103, 105, or be formed in only a portion thereof. Moreover, in various other embodiments, instead of a groove 116, the cams 103, 105 can include a protrusion. No matter the particular configuration, when either one of the cams 103, 105 rotates, it mechanically operates the switch actuator 106 to appropriately activate or deactivate the switch 104.

The switch assembly 104 includes a switch housing 178, and two switches, an extend switch 180 and a retract switch 182. The switch housing 178 houses internal circuitry (not shown) that is in operable communication with, for example, a display or an aircraft instrumentation and control system (not shown). The internal circuitry is also in operable communication with the extend and retract switches 180, 182. In the depicted embodiment, the extend and retract switches 180, 182 are implemented as button-type switches. However, it will be appreciated that this is merely exemplary of any one of numerous types of switch types that could be used. The extend 180 and retract 182 switches, as the names connote, are used to indicate that the aircraft leading edge flaps are in the extended or retracted positions, respectively. To this end, the switches 180, 182 cooperate with the wiring in switch housing 178 to send signals communicating the position of the leading edge flaps to the display or aircraft instrumentation and control system.

Figure 2:
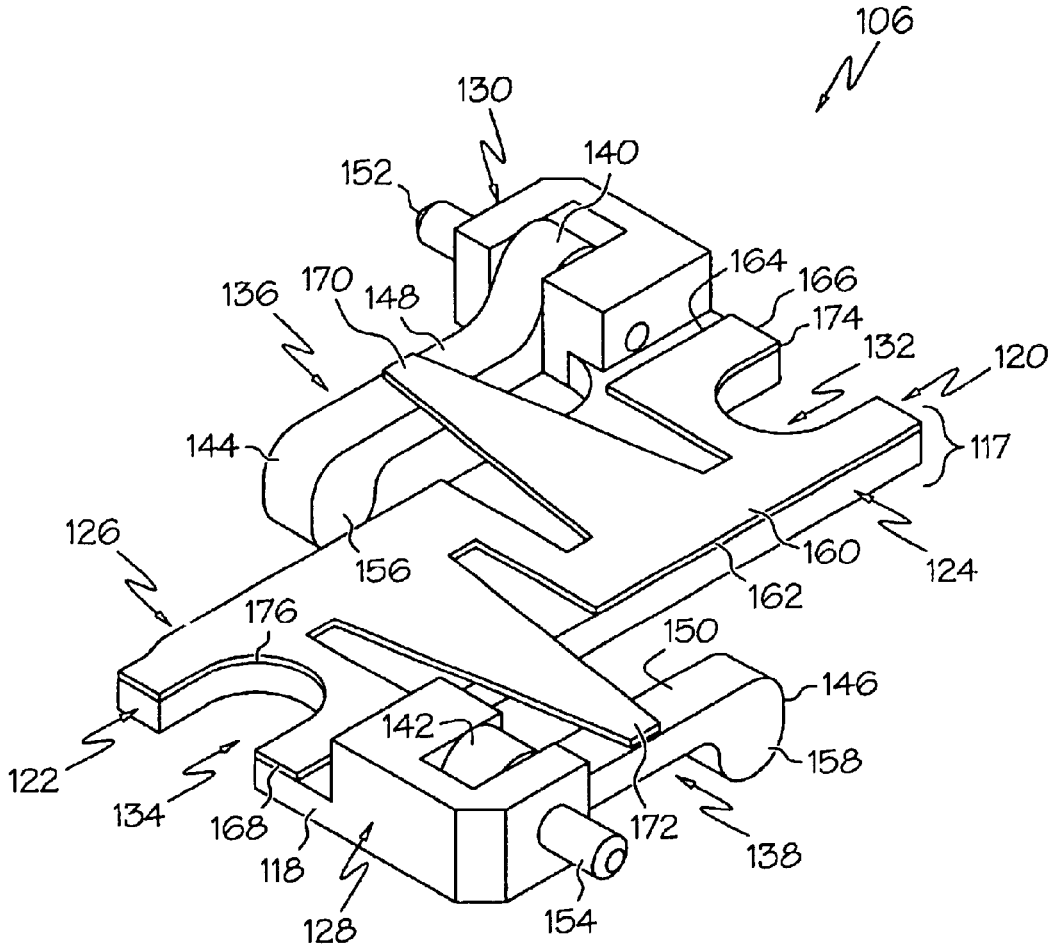
FIG. 2 is a perspective view of the switch actuator of FIG. 1.

Turning to FIG. 2, a plan view of the switch actuator of FIG. 1 is shown. Switch actuator is mounted to the switch housing 101, at an appropriate height and width between cam assembly 102 and switch 104, via spacer 108. The switch actuator 106 includes a base 117, and one or more actuator arms. In the depicted embodiment, the base 117 includes two plates, a mount plate 118 and a spring plate 160, and two actuator arms, an extend actuator arm 136 and a retract actuator arm 138. The mount plate 118 and spring plate 160 are preferably spot-welded to one another, but it will be appreciated that these components could be coupled to one another via screws, adhesives, or by any one of numerous other known coupling mechanisms.

In the depicted embodiment, the mount plate 118 is substantially rectangular in shape and includes a pair of shorter opposing, substantially parallel sides 120, 122, a pair of longer opposing, substantially parallel sides 124, 126, and actuator arm attachment segments 128, 130. Preferably, the mount plate 118 is machined from a single piece of material. Each of the shorter substantially parallel sides 120, 122 preferably includes a notch 132, 134 that extends toward the middle portion of the mounting plate 118. The notches 132, 134, together with screws (not shown), are used to secure the mount plate 118 and spacer 108 in the switch actuator assembly housing 110. The longer substantially parallel sides 124, 126 each include one of the actuator arm attachment segment 128, 130. In the depicted embodiment, the actuator arm attachment segments are diagonally positioned on opposite corners of the backing plate 118 from one another, and are substantially U-shaped. It will be appreciated, however, that this configuration and shape is merely exemplary of a particular embodiment, and that other configurations and shapes may be used, as may be suitable for other end-use systems. No matter the particular configuration or shape, the arm attachment segments 128, 130 are used to rotationally mount each of the actuator arms 136, 138 to the mount plate 118.

Each actuator arm 136, 138 includes a first end 140, 142 and a second end 144, 146 coupled together via a middle segment 148, 150, all preferably machined from a single piece of material. The first ends of the arms 140, 142 are disposed within the U of the arm attachment segment 128, 130, and are rotationally coupled to the backing plate 118 via hinge pins 152, 154. Specifically, each appendage of the U-shaped attachment segments 128, 130, and the first ends of the arms 140, 142 each include holes that are aligned with one another to receive the hinge pins 152, 154. The hinge pins 152, 154 are configured to rotationally secure the first ends of the actuator arms 140, 142 to the mount plate 118 and allow the second ends of the actuator arms 144, 146 to move freely in an arc-like motion.

The second ends of the actuator arms 144, 146 each include a protrusion 156, 158 that is preferably formed thereon or machined. Each protrusion 156, 158 engages the outer surface of, or fits within the groove 116 of, one of the extend or retract cams 103, 105 when the controller assembly 100 is actuated. In this embodiment, the protrusions 156, 158 have a bulb-like shape that fits and rests in the cam groove 116 (shown in FIG. 1), however, the protrusions 156, 158 may be hammer-shaped, V-shaped, or any one of numerous other solid shapes. In other embodiments, if the cams 103, 105 include a protrusion, instead of a groove, the actuator arms 136, 138 can be configured without protrusions.

The actuator arms 136, 138 and the mount plate 118 preferably comprise materials that are able to withstand frequent application of force and that does not easily fracture or break. Such materials can be polyether ether ketone, copper beryllium, 304 stainless steel or any one of numerous other known materials known in the art that possess the strength and ability to withstand frequent applications of small forces. In the case of the actuator arms 136, 138, the integrity of the arms may be dependent upon dimensions and what material is used to configure to the dimensions. For instance, in this embodiment, the arms are preferably made of polyether ether ketone (e.g., PEEK). In such case, the actuator arm protrusion 156, 158 is preferably about three times as thick as the middle segment 148, 150.

The spring plate 160 is coupled to the mount plate 118, as was noted above, and is configured to restrict movement of the actuator arms 136, 138, and supply a bias force to each actuator arm 136, 138. Spring plate 160 is sized substantially similar to the mount plate 118, and thus includes a pair of long substantially parallel edges 162, 164, a pair of short substantially parallel edges 166, 168, and two spring arms 170, 172. In the depicted embodiment, the spring arms 170, 172 are located on opposite sides of the spring plate 160 from one another. Preferably, each spring arm 170, 172 extends at least to a point that it contacts the middle segment 148, 150 of its corresponding actuator arm 136, 138. To aid in providing a spring-like property to the spring arms 170, 172, each spring arm 170, 172 is flanked by two V-shaped cutouts. The short substantially parallel edges 166, 168 each include an indentation 174, 176 similar in shape and size to notches 132, 134. Indentations 174, 176 are machined such that when the spring plate 160 is appropriately mounted on mount plate 118, the indentations 174, 176 and notches 132, 134 are in alignment with one another. The spring plate 160 is preferably comprised of 17-7 pH stainless steel, however, the plate may be made of any one of numerous other materials known in the art that possess spring-like properties.

Figure 3:
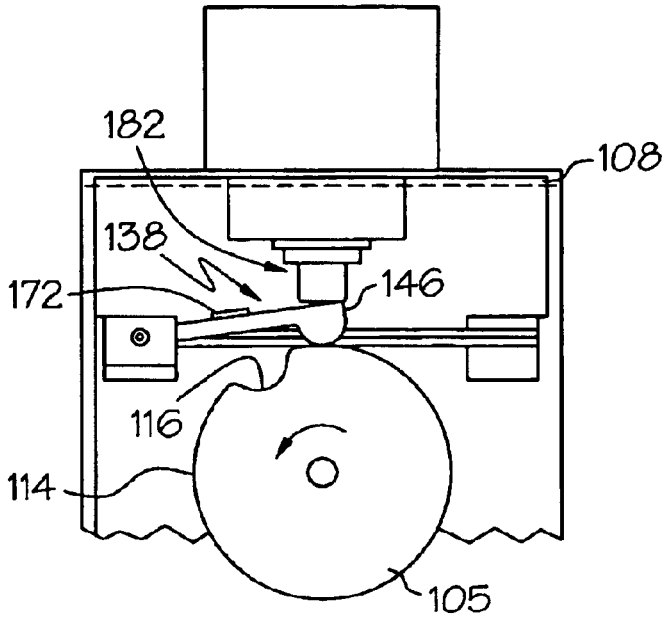
FIG. 3 is a cross-sectional view of switch actuator assembly of FIG. 1 taken along lines A—A showing activated switch 104, according to an exemplary embodiment of the invention.

FIG. 3 shows a cross-section view of the controller assembly 100 taken along line A—A of FIG. 1. In this view, the retract switch 182 of FIG. 1 is activated and the extend switch 180 is deactivated. Here, as previously described, LEFD gear drive 117 actuates translating screw assembly 107. Once actuated, shaft 110 rotates and causes nut 112 to travel linearly along shaft 110 to engage retract cam 105. When this occurs, further rotation of shaft 110 causes cam 105 to rotate a predetermined amount. As cam 105 rotates, actuator arm 138 moves out of groove 116 and onto cam surface 114. Cam surface 114 in turn elevates actuator arm 138, causing arm 138 to activate retract switch 180, thereby sending an appropriate signal to the display or aircraft instrumentation and control system. Actuator arm 138 is biased toward the deactivate position via spring arm 172.

Figure 4:
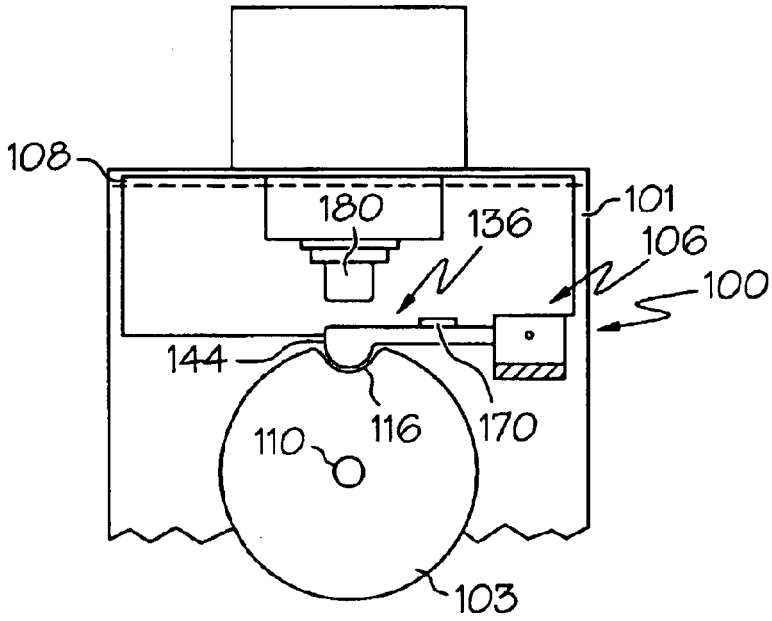
FIG. 4 is the cross-sectional view of switch actuator assembly of FIG. 1 taken along lines B—B showing deactivated switch 104, according to an exemplary embodiment of the invention.

While nut 112 is engaged with retract cam 105, extend cam 103 is not engaged, as shown in FIG. 4. FIG. 4 illustrates a cross-sectional view of the switch actuator assembly taken along line B—B of FIG. 1. In this embodiment, when extend cam 103 is not engaged by nut 112, actuator arm 136 remains within groove 116. Thus, extend switch 180 is not activated.

It will be appreciated that although FIGS. 3-5 illustrate a switch actuator assembly 100 wherein the extend switch 180 is not activated and the retract switch 182 is activated, at times, the translating screw assembly 107 will engage neither the extend or retract cams 103, 105 and thus, neither the extend or retract switches 180, 182 will be activated.

Therefore, a robust design that is cost and space efficient has been provided. The switch actuator assembly of the invention reduces the frequency of replacing the switch actuator and reduces the costs associated with replacement.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A switch actuator assembly, comprising:

a mount plate having at least a first side, a second side, and an outer peripheral surface;

an actuator arm rotationally coupled to the mount plate and rotationally moveable between at least an activate position and a deactivate position; and a spring arm coupled to the mount plate and extending away from the mount plate outer peripheral surface, the spring arm configured to supply a force that biases the actuator arm toward the deactivate position at least when the actuator arm is in the activate position.

2. The switch actuator assembly of claim 1, wherein the actuator arm comprises polyether ether ketone.

3. The switch actuator assembly of claim 1, wherein the actuator arm comprises beryllium copper.

4. The switch actuator assembly of claim 1, wherein the mount plate comprises 304 stainless steel.

5. The switch actuator assembly of claim 1, wherein the spring arm comprises a metal having spring properties.

6. The switch actuator assembly of claim 5, wherein the metal is 17-7 pH stainless steel.

7. The switch actuator assembly of claim 1, further comprising:

a spring plate coupled to the mount plate first side, wherein the spring arm is located on the spring plate.

8. The switch actuator assembly of claim 1, further comprising:

an actuator disposed proximate the actuator arm, the actuator adapted to receive a drive force and move the actuator arm, upon receipt of the drive force, between the activate and deactivate positions.

9. The switch actuator assembly of claim 8, wherein the actuator is a cam.

10. A switch actuator assembly, comprising:

a mount plate having at least a first side, a second side, and an outer peripheral surface;

a first and a second actuator arm each rotationally coupled to the mount plate and each rotationally and independently moveable between at least an activate position and a deactivate position; and first and second spring arms coupled to the mount plate and each extending away from the mount plate outer peripheral surface, the first and second spring arms each configured to supply a force that biases the first and second actuator arms toward the deactivate position, respectively, at least when the first or the second actuator arm is in the activate position.

11. A switch actuator assembly comprising:

a mount plate having at least a first side, a second side, and an outer peripheral surface;

an actuator arm rotationally coupled to the mount plate and rotationally moveable between at least an activate position and a deactivate position;

a spring arm coupled to the mount plate and extending away from the mount plate outer peripheral surface, the spring arm configured to supply a force that biases the actuator arm toward the deactivate position at least when the actuator arm is in the activate position; and a switch assembly disposed proximate the mount plate having a switch selectively moveable between a closed position and an open position in response to actuator arm movement between the activate and deactivate positions, respectively.

12. The switch actuator assembly of claim 11, wherein the actuator arm comprises polyether ether ketone.

13. The switch actuator assembly of claim 11, wherein the actuator arm comprises beryllium copper.

14. The switch actuator assembly of claim 11, wherein the mount plate comprises 304 stainless steel.

15. The switch actuator assembly of claim 11, wherein the spring arm comprises a metal having spring properties.

16. The switch actuator assembly of claim 15, wherein the metal is 17-7 pH stainless steel.

17. The switch actuator assembly of claim 11, further comprising:

a spring plate coupled to the mount plate first side, wherein the spring arm is located on the spring plate.

18. The switch actuator assembly of claim 11, further comprising:

an actuator disposed proximate the actuator arm, the actuator adapted to receive a drive force and move the actuator arm, upon receipt of the drive force, between the activate and deactivate positions.

19. The switch actuator assembly of claim 18, wherein the actuator is a cam.

* * * * *